United States Patent [19]

Berman et al.

[11] Patent Number: 4,715,650

[45] Date of Patent: Dec. 29, 1987

[54] FULLY COLLAPSIBLE PORTABLE CHAIR

[76] Inventors: Cary Berman, 450 Merion Rd., Merion, Pa. 19066; Steven Kiss, 10616 Lockart Rd., Philadelphia, Pa. 19116

[21] Appl. No.: 33,866

[22] Filed: Apr. 6, 1987

Related U.S. Application Data

[63] Continuation of Ser. No. 831,218, Feb. 20, 1986, abandoned.

[51] Int. Cl.[4] ..... A47C 4/00

[52] U.S. Cl. ..... 297/28; 297/45; 297/350; 403/100

[58] Field of Search ..... 297/350, 17, 27, 28, 297/31, 39, 45; 403/100, 102

[56] References Cited

U.S. PATENT DOCUMENTS

| | | | |
|---|---|---|---|
| 633,012 | 9/1899 | Kidd et al. | 297/380 |
| 1,036,222 | 8/1912 | Griffenberg | 403/102 |
| 2,243,502 | 5/1941 | Freedman | 297/28 |
| 2,778,407 | 1/1957 | Schweizer | 297/27 |
| 2,871,921 | 2/1959 | Arnold | 297/45 |
| 3,099,478 | 7/1963 | Pearlstine | 297/28 |
| 3,228,724 | 1/1966 | Resar | 297/45 |
| 3,655,297 | 4/1972 | Bolen, Jr. et al. | 403/100 |
| 3,989,295 | 11/1976 | Sparkes | 297/39 |
| 4,160,607 | 7/1979 | Reichow | 403/100 |
| 4,514,009 | 4/1985 | Vanderminden et al. | 297/27 |

*Primary Examiner*—Francis K. Zugel

*Attorney, Agent, or Firm*—David J. Johns

[57] ABSTRACT

A collapsible folding lawn chair is provided. Employing a chair of the folding frame and "sling seat" variety, a second level of compactness is achieved by addition of flexible locking hinges intermediate certain straight members of the frame. The chair remains a readily assembled single unit yet collapses to an easily transported and stored size. Additional features such as fully reclinability can be readily provided with minimal increase in the storage size of the chair.

10 Claims, 8 Drawing Figures

FIG. 1.
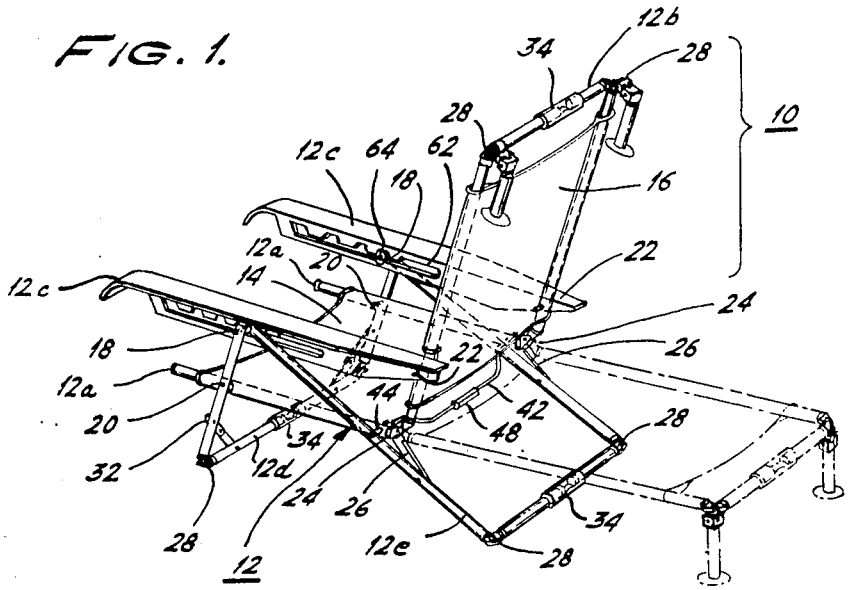
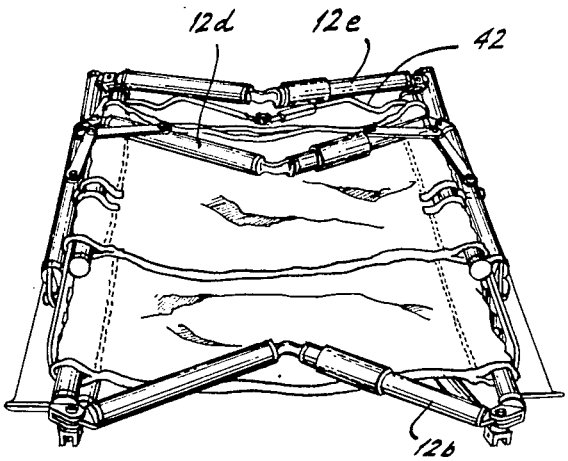
FIG. 2a.
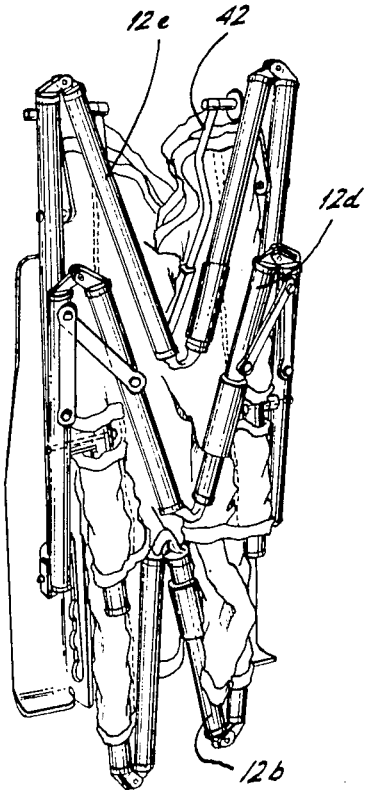
FIG. 2b.
FIG. 2c.
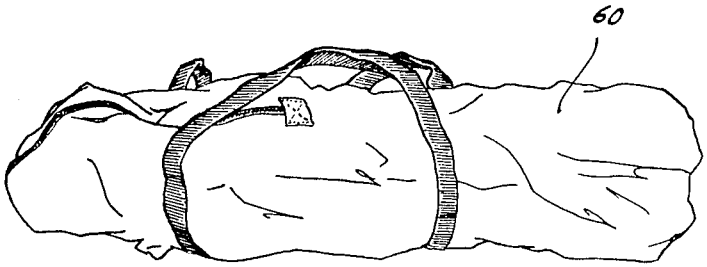

FIG. 3.
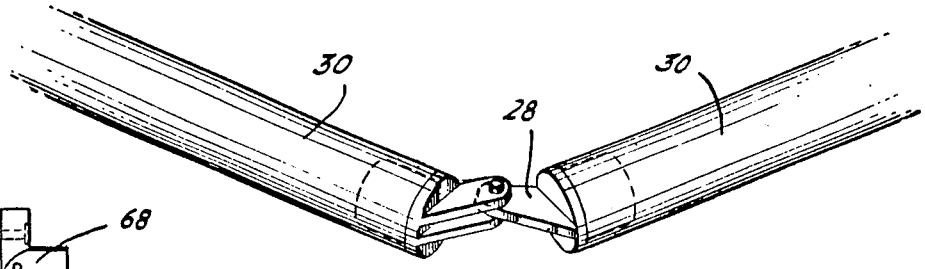
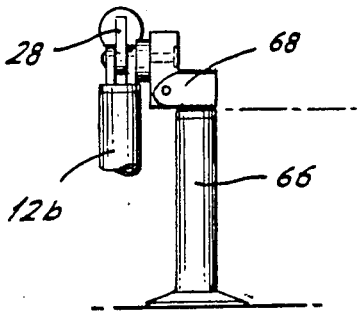
FIG. 6.
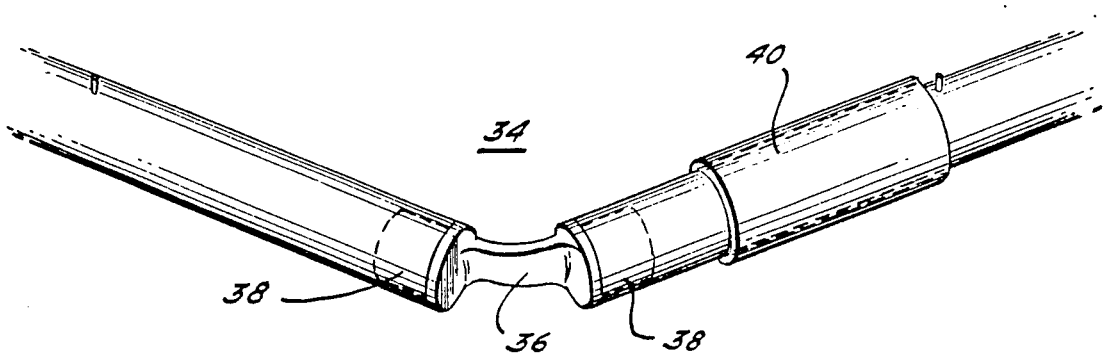
FIG. 4.
FIG. 5.
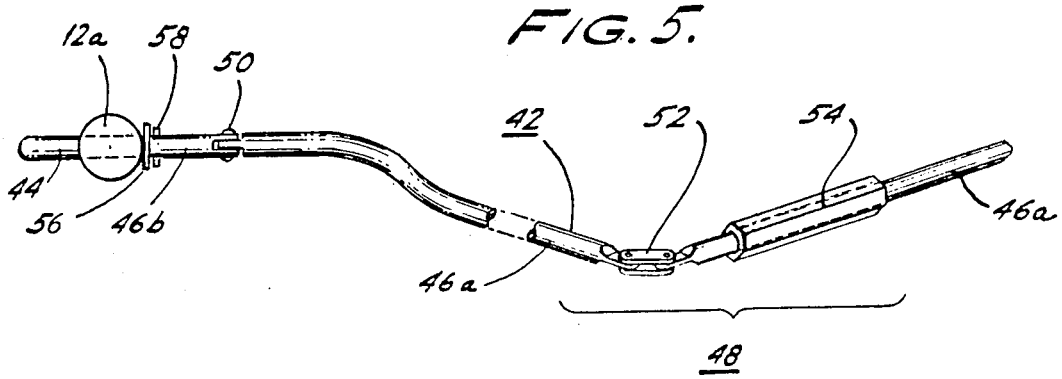

FULLY COLLAPSIBLE PORTABLE CHAIR

This application is a continuation of application Ser. No. 831,218 filed Feb. 20, 1986, now abandoned.

BACKGROUND OF THE INVENTION

The field of the present invention is portable chairs, particularly foldable or collapsible portable chairs.

Although portable chairs have long been known, a constant concern has been to construct portable chairs that are comfortable and durable, yet are capable of being easily compacted into minimal space and then readily reassembled. Various attempts towards this end are the following:

U.S. Pat. No. 2,564,915 to Nelson
U.S. Pat. No. 3,695,702 to Ingellis
U.S. Pat. No. 4,514,009 to Vanderminden et al.

As is true with other known collapsible or portable chairs, these devices may function adequately well, but they are each deficient in one or more respects. First, most portable chairs are only minimally compactable. Typically a "portable" chair continues to be unwieldy and to provide storage problems even in its folded or compacted position. Those chairs that thoroughly collapse usually provide a plethora of separate pieces which are easily misplaced and create an undesired challenge for reassembly. Second, many folding chairs are uncomfortable and are limited by little or no adjustability.

To some extent the collapsibility of portable chairs has been constrained by the types of hinges available. As a practical matter, in order to repeatedly fold a chair, flexible hinges must be employed that accept pivoting in more than one plane of movement; however, such hinges must be capable of being locked into position once the chair is fully assembled. Examples of previous attempts, to create locking hinges are U.S. Pat. No. 1,036,222 to Griffenberg and U.S. Pat. No. 4,160,607 to Reichon. Although these devices may function well in their particular applications, they do not solve the problems found in creating a fully collapsible folding chair. The hinge required in a fully collapsing portable chair needs to be quite flexible in the open position and strong enough to withstand the stresses of repeated distortions, yet resistant to all movement when in the locked position.

It is therefore an object of the present invention to provide a flexible locking hinge which can withstand the stresses inherent in fully collapsing a portable chair, yet provide a secure, unified structure when locked.

It is another object of the present invention to provide a portable chair that readily and thoroughly collapses into a compact easily transportable and storable single unit that is quickly and easily reassembled.

It is a further object of the present invention to provide a portable chair that is comfortable and allows for a full range of adjustability, from upright sitting to fully reclining positions.

SUMMARY OF THE INVENTION

The present invention is directed to a fully collapsible portable chair. The invention involves employing sleeve-locked flexible "living" hinges intermediate certain straight members of a folding chair frame to allow a second level of compacting. This provides a chair that may be fully compacted, yet remains a single unit so to permit uncomplicated reassembly.

The present invention can be applied to all common forms of portable or "lawn" chairs and in each case an easily transportable and storable chair is created. Moreover, the unencumbered nature of the present invention along with the degree of compactness that can be achieved by employing it, permits creation of full feature chairs which require a mere fraction of the storage space of more spartan prior art models. Thus truly portable chairs can be created containing such features as a full range of reclinability and a full height back providing head support.

DESCRIPTION OF THE DRAWINGS

The operation and features of the present invention should become apparent from the following description when considered in conjunction with the accompanying drawings, in which:

FIG. 1 is a perspective view of a said chair in which the present invention is incorporated;

FIG. 2*a* is the sand chair of FIG. 1 folded and partially collapsed;

FIG. 2b is the sand chair of FIG. 1 folded and completely collapsed;

FIG. 2*c* is the sand chair of FIG. 2*b* placed within a carrying bag;

FIG. 3 is a three-quarters view of a corner hinge used in the present invention;

FIG. 4 is a three-quarters view of one embodiment of the intermediate hinged joint used in the present invention.

FIG. 5 is a three-quarters view of the reinforcement rod used in the present invention; and FIG. 6 is a side view of a folded leg employed in the present invention.

DETAILED DESCRIPTION OF THE INVENTION

The present invention is directed to a fully collapsible folding chair designed primarily as a compact, easily transportable, chair for outdoor use.

There is illustrated in FIG. 1 a low or "sand" chair 10 incorporating the present invention. The chair 10 comprises a stiff frame 12, having seat frame 12*a*, back frame 12*b*, chair arms 12*c*, 12*c*, forward ground support 12*d*, and rear ground support 12*e* portions, and a flexible "sling-type" seat support 14 and back support 16. The seat support 14 and the back support 16 are stretched and anchored across the seat frame 12*a* and back frame 12*b*, respectively, in a known manner.

Each portion of the frame 12 is constructed from relatively stiff solid or tubular material which, due to elements encountered in outdoor use, should be thoroughly weather resistant. Tubular material such as 1 inch diameter aluminum or $\frac{7}{8}$ inch diameter stainless steel, or, for lighter occupants, 1 inch diameter polycarbonate or 1 inch diameter Acrylonitrile Butadine Styrene (A.B.S.) tubing should all perform admirably. The seat support 14 and back support 16 material may be of any form commonly employed, such as canvas or nylon. Lighter weight materials, such as aluminum tubing and nylon cloth, are preferred because they contribute to portability.

As is common in the prior art, the back frame 12*b* of the present invention folds forward against the seat frame 12*a*. This is accomplished through use of: dual arm hinges 18, 18, which each connect the forward ground support 12*d* to the rear ground support 12*e* at each of the chair arms 12*c*, 12*c*; dual forward pivots 20, 20 of known construction, which each connect the seat frame tubes 12*a*, 12*a* to the forward ground support 12*d*, while allowing the seat frame 12*a* to rotate independently from the forward ground support 12*d* around the points of connection; dual arm pivots 22, 22 of known construction, which each connect the back frame 12*b* to the chair arms 12*c*, 12*c*, while allowing the back frame 12*b* to rotate independently from the chair arms 12*c*, 12*c* around the points connection; dual seat-back hinges 24, 24, which each connect the back frame 12*b* to the seat frame tubes 12*a*, 12*a*; and dual swing arms 26, 26 of known construction, which each connect the seat-back hinges 24, 24 to the rear ground support 12*e*, while allowing the seat-back hinges 24, 24 to move, within the constraints of the length of each of the swing arms 26, 26, relative to the rear ground support 12*e*.

When the back frame 12*b* folds against the top of the seat frame 12*a*, the forward ground support 12*d* will pivot backwards around the forward pivots 20, 20 and will fold against the bottom of the seat frame 12*a*. The result is a relatively flat folded chair in a form similar to that which is found in certain prior art chairs.

The present invention, however, does not merely fold in half, it also simply and readily collapses to make it significantly more compact and portable than the chairs found in the prior art. Corner hinges 28 are provided at each of the corners of the forward ground support 12*d*, the rear ground support 12*e*, and the back frame 12*b*. These may be of any type of hinge which will maintain the transverse or horizontal positions of the forward and rear ground supports 12*d*, 12*e* and the back frame 12*b* at a right angle to the side or upright portions of the ground supports 12*d*, 12*e* and the back frame 12*b* when the chair 10 is in an open position.

The preferred corner hinge 28 is shown in FIG. 3. The hinge shown is a rigid hinge of a known "plug" variety which can be readily inserted into two tubes 30, 30. The hinge 28 may be constructed from any material of suitable strength which permit insertion into a tubular member, such as polycarbonate, A.B.S., or metal tubing, such as aluminum or stainless steel. Similar hinges may be employed as the arm hinges 18, and the seat-back hinges 24.

A folding brace 32 is provided at each of the two corners of the forward ground support 12*d* extending between the horizontal and upright portions thereof. When the brace 32 is locked in an open position it limits the stress placed on the corner hinges 28 of the forward ground support 12*d* and assists in maintaining the right angle between the horizontal and upright portions of the ground support 12*d*.

Intermediate the corner hinges 28 of each of the horizontal portions of the forward ground support 12*d*, rear ground support 12*e*, and the back frame 12*b* are hinged joints, which in the preferred embodiment are unique devices the inventors refer to as "living hinges" 34. As is shown in FIG. 4, each living hinge 34 comprises a flexible ligament 36 connecting two end plugs 38, 38, and a sleeve 40. Each horizontal portion of the forward ground support 12*d*, rear ground support 12*e*, and the back frame 12*b* is divided into two halves with a space separating them approximately equal to the length of the flexible ligament 36. The connecting plugs 38, 38 are inserted into the divided halves of the horizontal portions thus creating a flexible connection between the divided portions via the ligament 36. This permits each of the horizontal portions of the forward ground support 12*d*, rear ground support 12*e*, and the back frame 12*b* to be folded substantially in half as shown in FIG. 2. The ligament 36 and connecting plugs 38 may be constructed from any strong, flexible material which will withstand the various stresses involved with repeated flexing and twisting. A one piece unit incorporating both the ligament 36 and the connecting plugs 38 constructed from smooth polypropylene, with a ligament 36 thickness of approximately 0.08 inch, has proven to be effective. Further, as is shown in FIG. 4, it is desirous to have the flexible ligament 36 assymetrically placed between the end plugs 38, 38 so to provide a bias as to the direction of hinging. This limits the stresses on the ligament 36 and eliminates uncertainty for the user as to the direction of fold.

Each sleeve 40 is provided to be of sufficient length to easily traverse the divided horizontal portions of the forward ground support 12*d*, rear ground support 12*e*, and back frame 12*b* and to cover the area surrounding the ligament 36. Additionally, each sleeve 40 should fit snugly yet slidably around each horizontal portion. To assemble the chair 10, the ligament 36 portion of each living hinge 34 is straightened and each sleeve 40 is slid to traverse the ligament 36 and cover a part of each divided horizontal portion, thereby locking the two halves into a rigid linear member.

Connected between the seat-back hinges 24, 24 and passing through the swing arms 26, 26 is a reinforcement rod 42, which accomplishes two important tasks. First, the reinforcement rod 42 passes through each of the plug portions of the seat-back hinges 24 inserted in the seat frames 12*a* and forms an extension 44 of the reinforcement rod 42 on each outwardly facing side of the seat frame 12*a*. Each extension 44 is provided to rest against the upright portions of the rear ground support 12*e* and assist in suspending the seat and back portions of the chair 10 above the ground. Second, the reinforcement rod 42 assists in maintaining the structural integrity of the chair 10. The reinforcement rod 42 keeps the seat frame 12*a*, and thus the back frame 12*b* via the seat-back hinges 24, 24, in proper alignment and contributes to greater rigidity.

The reinforced rod 42 may be constructed from any strong rigid material, such as stainless steel. It should be contoured downward, as shown in FIG. 1, so to avoid uncomfortable contact with the occupant of the chair 10.

The reinforcement rod 42 is divided into four sections, two intermediate sections 46*a*, 46*a* connected by a sleeve covered joint 48, and two exterior sections 46*b*, each connected to one of the intermediate sections 46*a* via rod hinges 50. As is shown in FIG. 5, the sleeve covered joint 46 comprises a double hinge 52 and slidable small sleeve 54. A double hinge 52 having two pivot points each connected to one of the intermediate sections 46*a* is desired so to increase the flexibility of the joint and to permit the reinforcement rod 42 to be folded in half between the rod hinges 50. The sleeve covered joint 48 locks into an open position by sliding the sleeve 54 over the double hinge 52 in a manner similar to the locking of the living hinge 34. A washer 56 and pin 58 are provided on each exterior section 46*b* to maintain the reinforced rod 42 in proper position with respect to the seat frame tubes 12*a*, 12*a* when the reinforcement rod 42 is in a locked open position.

By disengaging the sleeve 40 on each of the living hinges 34, disengaging the small sleeve 54 on the sleeve covered joint 48, and unlocking both folding braces 32, the horizontal portions of the forward ground support 12*d*, rear ground support 12e, and back frame 12*b* along with the reinforcement rod 42 may be folded in the manner shown in FIGS. 2*a*–2*c*. The entire chair 10 can then be collapsed into a relatively small area and be carried or stored in a carrying bag 60.

An additional feature of the present invention is its ability to completely recline. This is accomplished by having the angle of the back frame 12*b* in the fully assembled chair 10 controlled solely by the positioning of the chair arms 12*c*, 12*c* attached to the back frame 12*b* at the arm pivots 22, 22. In the preferred embodiment shown in FIG. 1, each of the chair arms 12*c*, 12*c* are provided with a notched groove 62, 62 of known construction. Each notch of each of the notched grooves 62 is adapted to engage a capped cylindrical projection 64 attached to and facing inwardly from the pivot point of each of the arm hinges 18, 18. In this manner, various angles of incline of the back frame 12*b* can be achieved by merely disengaging an engaged notch of each notched groove 62 from the capped cylindrical projection 64, sliding each chair arm 12*c*, 12*c* to acquire the desired angle, and then engaging a new notch of the notched groove 62 against the capped cylindrical projection 64 at the angle of incline.

A fully reclined position is achieved by permitting the chair arms 12*c*, 12*c* to slide completely backwards with the capped cylindrical projections 64 encountering the forward end of each of the notched grooves 62, 62 at the fully reclined position. This position is shown in phantom in FIG. 1. As is shown in FIG. 6, legs 66, 66, attached to leg hinges 68 of similar construction to the corner hinges 28, are provided at the corner hinges 28, 28 of the back frame 12*b* to fold down and support the back frame 12*b* in the fully reclined position.

It should be appreciated that the present invention may be similarly applied to other known designs of chairs, including full height, upright lawn chairs, and reclining lounge chairs. The final result in all these applications is a full feature folding chair which can be readily collapsed into a one-piece unit of relatively small and easily transportable size.

While a particular embodiment of the present invention has been disclosed herein, it is not intended to limit the invention to such a disclosure and changes and modifications may be incorporated and embodied within the scope of the following claims.

What is claimed is:

1. In a collapsible chair having a frame of joined vertical and horizontal members defining a seat, a back, and a plurality of ground supports, said frame capable of being compacted by folding the seat, back, and ground supports together into a flattened unit, containing an improvement comprising providing a set of first vertical members and a set of second vertical members, the vertical members of each set positioned parallel to and in a plane with each other;

said set of first vertical members being hingedly connected by at least one horizontal member, said horizontal member being provided with a hinged joint intermediate its ends permitting said horizontal member to be folded into two sections assuming a position approaching substantially parallel to, and within the plane of, said first vertical members;

said set of second vertical members being hingedly connected by at least one horizontal member, said horizontal member being provided with a hinged joint intermediate its ends permitting said horizontal member to be folded into two sections assuming a position approaching substantially parallel to, and within the plane of, said second vertical members;

wherein the planes of said set of first vertical members and said set of second vertical members approach a position of parallel to each other when said chair is folded into a flattened unit;

said hinged joint comprising a flexible ligament affixed to two end plugs, and a sleeve;

said ligament being of sufficient width and being affixed to said end plugs off center so to create a directional bias, allowing said hinged joint to fold fully in only one direction;

said end plugs being adapted to join to and connect the sections of said horizontal members and maintain said members a fixed linear distance apart when said members are coaxially aligned; and said sleeve being positioned around said horizontal member and adapted to slide to surround and to traverse said ligament and hold said sections of the horizontal member in linear relationship to each other.

2. A collapsible chair of claim 1 wherein said flexible ligament and said connecting plugs are constructed from the same flexible material.

3. A collapsible chair of claim 2 wherein said flexible material is polypropylene.

4. A collapsible chair of claim 1 wherein said back and seat are hingedly connected and capable of being positioned in different angles in respect to each other.

5. A collapsible chair of claim 4 wherein the angle between said back and seat is controlled by at least one chair arm attached intermediate the ends of said back.

6. A collapsible chair of claim 5 wherein an angle between said back and seat is maintained by securing said chair arm into a fixed position.

7. A collapsible chair of claim 4 wherein said back and seat may be positioned at an angle substantially 180° with respect to each other.

8. A collapsible chair of claim 7 wherein said back is provided with at least one leg to assist in supporting said back when said seat and back are positioned at an angle substantially 180° with respect to each other, which leg folds parallel to a first vertical member when said back is in an upright position and in a folded position.

9. A collapsible chair of claim 1 wherein a reinforcement rod is provided between opposite members of said seat.

10. A collapsible chair of claim 9 wherein said reinforcement rod is divided into at least two portions joined by a double hinge and is provided with a sleeve to slide over said double hinge, contact each said portion, and cause said portions to be held in linear relationship to each other.

* * * * *